US006413058B1

(12) United States Patent
Williams et al.

(10) Patent No.: US 6,413,058 B1
(45) Date of Patent: Jul. 2, 2002

(54) VARIABLE CAPACITY MODULATION FOR SCROLL COMPRESSOR

(75) Inventors: John R. Williams, Bristol, VA (US); James W. Bush, Skaneateles, NY (US); Zili Sun; Carlos Zamudio, both of Arkadelphia, AR (US); Jason Hugenroth, Hope, AR (US); Greg Hahn; Thomas Barito, both of Arkadelphia, AR (US); Joe T. Hill, Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/718,065

(22) Filed: Nov. 21, 2000

(51) Int. Cl.[7] ..... F04B 49/035; F04C 18/04; F04C 29/08

(52) U.S. Cl. ..... 417/440; 418/15; 418/55.1; 418/55.2

(58) Field of Search ..... 418/15, 55.1, 55.2; 417/440

(56) References Cited

U.S. PATENT DOCUMENTS 5,318,424 A * 6/1994 Buch et al. ..... 418/55.2

FOREIGN PATENT DOCUMENTS

| | | | | |
|---|---|---|---|---|
| EP | 0113786 | * | 7/1984 | ..... 418/55.1 |
| JP | 57-76287 | * | 5/1982 | ..... 418/55.1 |
| JP | 57-86588 | * | 5/1982 | ..... 418/55.1 |

* cited by examiner

*Primary Examiner*—John J. Vrablik
(74) *Attorney, Agent, or Firm*—Carlson, Gaskey & Olds

(57) ABSTRACT

A scroll compressor is provided that has greater control over the compressed volume by having a plurality of sequentially spaced unloader valves and associated holes. By providing the plurality of valves, a control achieves greater variation over the final compressed volume. The present invention is most preferably utilized in the type of scroll compressor having a hybrid wrap geometry to provide an increased volume of refrigerant adjacent the suction area of the compressor.

9 Claims, 2 Drawing Sheets

VARIABLE CAPACITY MODULATION FOR SCROLL COMPRESSOR

BACKGROUND OF THE INVENTION

This invention relates to capacity modulation techniques that provide variable control over the volume of compressed refrigerant.

Scroll compressors are widely used in refrigerant compression applications. A scroll compressor includes a first and a second scroll member each having a base and a generally spiral wrap extending from the base. The two wraps interfit to define compression chambers. One of the two scroll members is caused to orbit relative to the other. As the one scroll member orbits the size of the compression chambers decreases toward a central discharge port.

One main advantage from scroll compressors is the high efficiency. Scroll compressors do raise some design challenges, however, including capacity control.

Under some system conditions, the amount of refrigerant which is compressed may be desirably reduced from a maximum volume. Scroll compressors have been proposed wherein an unloader valve is mounted near the start of the suction port to communicate some of the refrigerant away from the compression chambers such that the compressed volume of refrigerant is reduced. This control is typically used when the system associated with the compressor has a less than maximum cooling demand.

To date, most capacity control mechanisms for scroll compressors have provided a limited amount of control over the total variation in the volume of compressed refrigerant.

SUMMARY OF THE INVENTION

In a disclosed embodiment of this invention, greater control over the capacity modulation, or the volume of refrigerant being compressed, is achieved by utilizing several sequentially arranged unloader valves. In a disclosed embodiment of this invention, a series of pairs of holes are formed through the base of the non-orbiting scroll member. Valves are associated with each pair of holes. A control for the system can control the valves such that less than all of the valves can be open, or alternatively all valves can be opened. Thus, the control has finer gradiation over the volume of refrigerant being compressed.

As is known, scroll compressors typically have a pair of chambers being moved toward the discharge port. An outer chamber is defined radially outward of the orbiting scroll wrap and an inner chamber is defined radially inward of the orbiting scroll wrap. The pair of holes include a hole associated with each of the inner and outer chambers.

In a further feature of this invention, capacity modulation is increased when a scroll wrap having a so-called "hybrid" geometry is utilized. Preferably, the hybrid geometry is such that the geometry of the scroll wrap differs from an involute of a circle to provide an increased volume of refrigerant adjacent the suction of the scroll compressor. Scroll wraps having such hybrid geometry are known, and the basic geometry of the scroll wrap forms no portion of this invention. However, by utilizing an unloader valve associated with the suction port in a scroll compressor having a hybrid wrap geometry, such that there is increased volume adjacent the suction port, even greater control over the final capacity of the scroll compressor is achieved.

These and other features of the present invention can be best understood from the following specification and drawings, the following of which is a brief description.

DETAILED DESCRIPTION OF A PREFERRED EMBODIMENT

Figure 1:
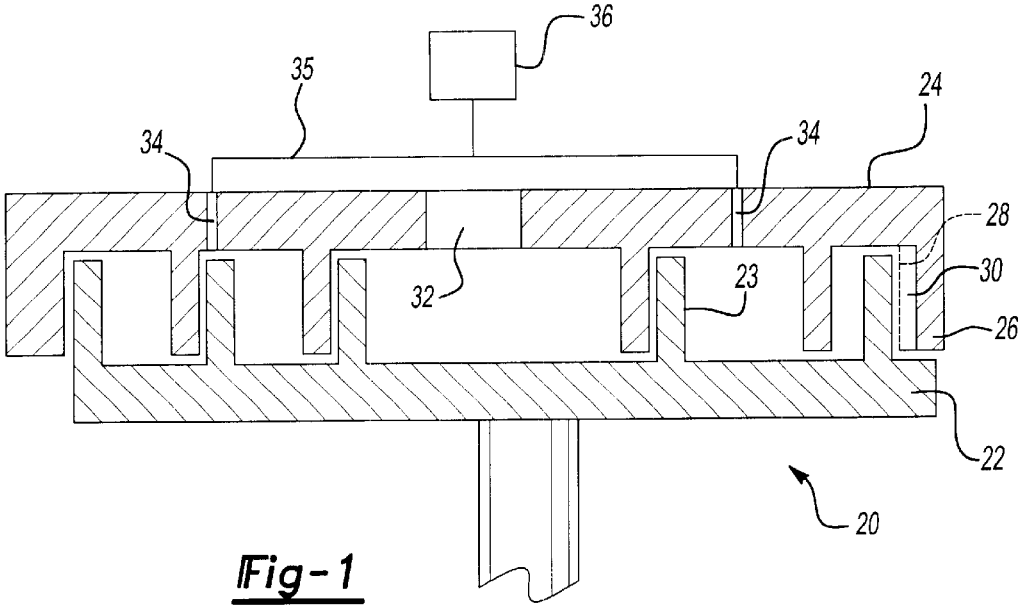
FIG. 1 is a cross-sectional view through a scroll compressor incorporating the present invention.

FIG. 1 shows a scroll compressor 20 incorporating an orbiting scroll 22 having a generally spiral wrap 23, and a non-orbiting scroll 24 having a generally spiral wrap 26. As known, the wraps 23 and 26 interfit to define compression chambers.

Historically, scroll compressors have had wraps which extend along an involute of a circle. With such wraps, some design optimizations cannot be achieved. Thus, more recently, scroll compressor designers have moved the generally spiral wrap geometries away from an involute of a circle geometry to other geometries. These geometries are called "hybrid" as they combine several different sections to provide distinct features at different points along the wrap.

One known type of scroll geometry includes an outer wrap for the non-orbiting scroll which extends further radially outwardly from a center of the non-orbiting scroll than would be the case for an involute of a circle wrap. This provides a greater volume adjacent the suction port, such that more refrigerant moves into the compression chambers.

As shown in phantom at 28, the involute of the circle would have the wrap radially inward from the actual location of the radially outermost wrap 26. An extra volume 30 as shown in FIG. 1 is provided by this concept. The concept of the increased volume is described somewhat schematically here, and a worker in this art would recognize the various aspects of the scroll wrap design are considered to achieve the most preferred hybrid geometry.

As also shown in FIG. 1, holes 34 extend through the base of the non-orbiting scroll and communicate with a fluid line 35. In practice, the line 35 would preferably extend through the base of the non-orbiting scroll 24. A valve 36 selectively communicates the holes 34 with a dump location, such as returning fluid from the holes 34 to a location upstream of the compressor suction port.

Figure 1A:
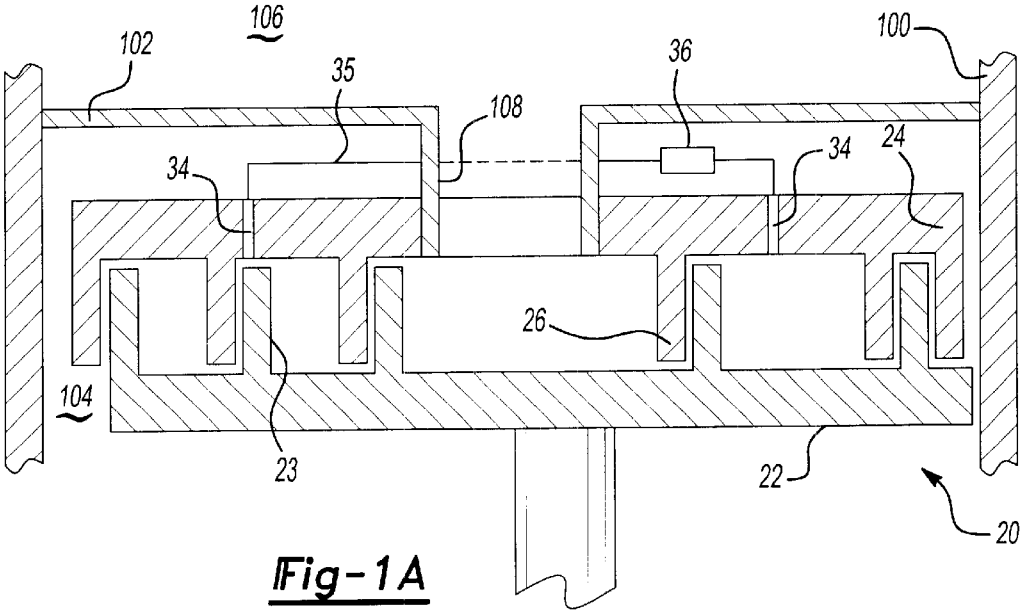
FIG. 1A is a cross-sectional view similar to FIG. 1, but showing additional structural features.

As shown in FIG. 1A, an outer housing 100 for the compressor receives a separator plate 102. The separator plate defines a suction pressure chamber 104 on one side and a discharge pressure chamber 106 on another. A discharge port 108 communicates with compression chambers defined between the wraps 23 and 26 to deliver compressed refrigerant to the chamber 106. As can be understood, the valve 36 is positioned such that when it opens flow from the holes 34, the refrigerant moves into an area communicating with the suction pressure chamber 104. In this sense, the refrigerant will be returned to a location upstream of the suction port leading into the compression chambers. This basic structure of a scroll compressor is as known. It is the location of the plural holes and their operation which is inventive here.

Figure 2:
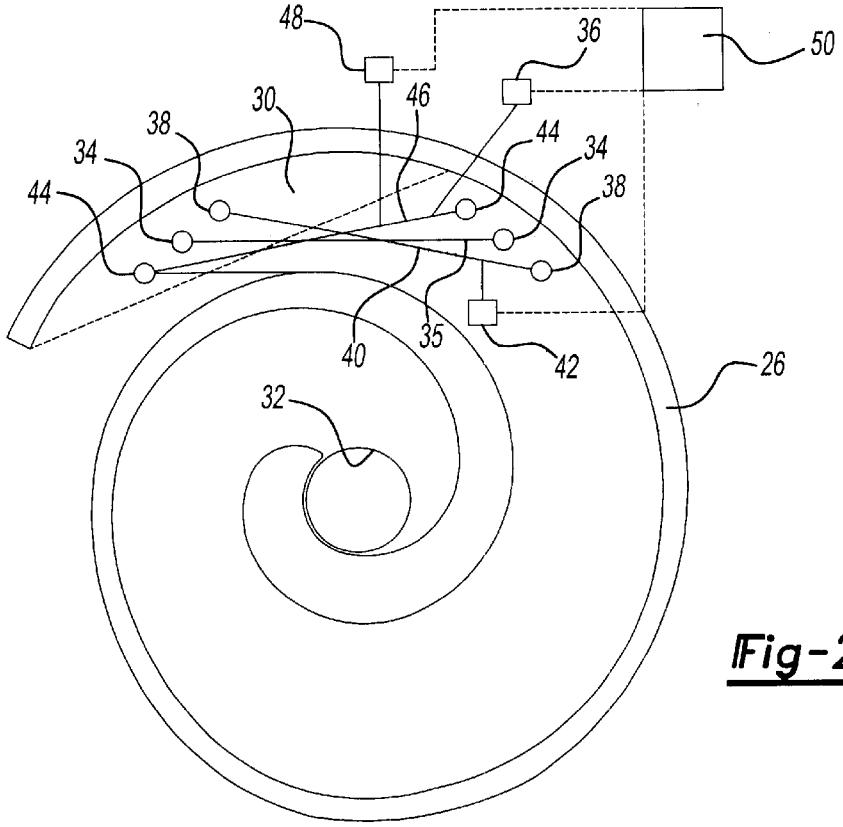
FIG. 2 is a schematic view showing features of the present invention.

As shown in FIG. 2, in a preferred embodiment, there are a pair of holes 34 arranged about a central axis of the scroll wrap. The holes 34 are each associated with one of the compression chambers defined by the interfitting scroll wraps 23 and 26. As is known, there is an outer chamber defined outwardly of the orbiting scroll wrap 23 and an inner chamber defined inwardly.

Figure 2A:
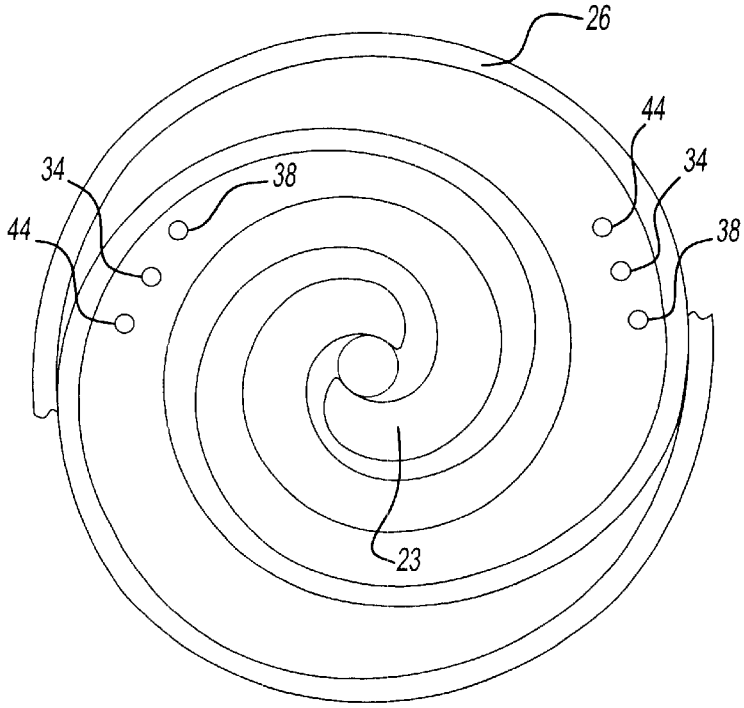
FIG. 2A is a view similar to FIG. 2, but showing additional structural features.

As can be appreciated, the scroll wraps 23 and 26 define two compression chambers as shown in FIG. 2A. The compression chambers each have their own associated sets of holes 44, 34 and 38. The system thus operates as described above. The exact location of the hole would depend on the particular goals of the scroll compressor designer, and the particular structure and operation of the scroll compressor.

The present invention further includes a second set of holes 38, which are connected by a line 40 and communicate with a valve 42. Further, a third set of holes 44 are connected by a line 46 and controlled by a valve 48. FIG. 2 shows this arrangement schematically. It should be understood that the lines 35, 40 and 46 preferably extend through the base of the non-orbiting scroll. It should further be understood that the valves 36, 42 and 48 act to selectively communicate fluid from the holes 34, 38 and 44 back to a location which is upstream of the suction port for the compressor 20.

A control S0 controls the valves 36, 42 and 48 to achieve a desired capacity. Thus, a system controller would identify a desired capacity. The control 50 would actuate the valves 36, 42 and 48 to selectively open, or remain closed, to achieve the reduced capacity desired by the system. It should also be understood that the controller 50 could be part of the system controller.

The control 50 is capable of opening some or all of the valves 36, 42 and 48. Thus, gradiations in the capacity control are provided by the three spaced valves. The prior art single unloader valve could not provide the gradiation, nor could it provide the total volume unloaded by the three holes.

In addition, it is important to recognize that this invention is directed to suction unloading valves. As can be understood from FIG. 2, the holes 34, 38 and 44 are placed within the first half of the compression cycle. The cycle being defined between the time when the scroll wraps initially move into contact and define compression chambers, until the time they discharge the compressed refrigerant to a discharge port.

The present invention is particularly well-suited in a type of compressor having the hybrid scroll wrap such that there is an increased volume 30 associated with the inlet port of the scroll compressor then would be provided if a scroll wrap on an involute 28 were utilized. With such a system there is an increased volume of refrigerant, and thus an increased ability to achieve a final desired volume of compressed refrigerant.

A preferred embodiment of this invention has been disclosed; however, a worker in this art would recognize that modifications would come within the scope of this invention. As one example only, it should be understood that more or less than three of the unloader hole pairs could be utilized. The claims in this application should thus be studied to determine the true scope and content of this invention.

We claim:

1. A scroll compressor comprising:

a first scroll member having a generally spiral wrap extending from a base;

a second scroll member having a generally spiral wrap extending from a base, said generally spiral wraps of said first and second scroll members interfitting to define compression chambers;

said second scroll member being driven to orbit relative to said first scroll member; and a capacity control mechanism including a plurality of pairs of holes extending through said base of said first scroll member, each of said plurality of holes being provided with a control valve communicating with a suction pressure chamber, and a control for selectively opening said control valves associated with some of said pairs of holes while leaving others of said pairs of holes closed to achieve a desired capacity.

2. A scroll compressor as recited in claim 1, wherein said plurality of pairs are arranged such that one hole in each of said pairs of holes is associated with a compression chamber defined between said wraps of said first and second scroll members.

3. A scroll compressor as recited in claim 1, wherein said plurality of holes are spaced sequentially along a direction of movement of said second scroll member relative to said first scroll member.

4. A scroll compressor as recited in claim 1, wherein separate valves are associated with each of said plurality of pairs, and a single control communicates with each of said separate valves.

5. A scroll compressor as recited in claim 1, wherein the wraps of at least said second scroll member is defined to have a geometry such that an increased volume of refrigerant is received at a suction position than would be provided if said wrap was defined by an involute of a circle.

6. A scroll compressor as recited in claim 1, wherein said pairs of holes of holes are placed within a first half of a compression cycle defined between the time when the scroll wraps initially close to move into contact, and until the time they discharge refrigerant to a discharge port.

7. A scroll compressor comprising:

a first scroll member having a base and a generally spiral wrap extending from a base, said generally spiral wrap being configured to have a geometry such that an increased volume of refrigerant is received adjacent a suction port than would be received if said wrap were defined on an involute of a circle;

a second scroll member having a base with a generally spiral wrap extending from said base, said generally spiral wraps of said first and second scroll members interfitting to define compression chambers;

said second scroll member being driven to orbit relative to said first scroll member; and a capacity control mechanism including a plurality of pairs of holes extending through said base of said first scroll member, each of said plurality of pairs being provided with a control valve communicating with a suction pressure chamber, and a control for selectively opening some of said control valves while leaving others closed to achieve a desired capacity, said plurality of holes being spaced sequentially along a direction of movement of said second scroll member relative to said first scroll member such that a variable final compressed volume can be achieved.

8. A scroll compressor as recited in claim 7, wherein said plurality of pairs are arranged such that one hole in each of said pairs of holes is associated with a compression chamber defined between said wraps of said first and second scroll members.

9. A scroll compressor as recited in claim 7, wherein said pairs of holes of holes are placed within a first half of a compression cycle defined between the time when the scroll wraps initially close to move into contact, and until the time they discharge refrigerant to a discharge port.

* * * * *